US010484785B2

(12) United States Patent
Tremblay

(10) Patent No.: US 10,484,785 B2
(45) Date of Patent: Nov. 19, 2019

(54) SPEAKER BAFFLE

(71) Applicant: IMAX Corporation, Mississauga (CA)

(72) Inventor: Denis Gilles Tremblay, Brampton (CA)

(73) Assignee: IMAX Corporation, Mississauga (CA)

( * ) Notice: Subject to any disclaimer, the term of this patent is extended or adjusted under 35 U.S.C. 154(b) by 0 days.

(21) Appl. No.: 15/146,213

(22) Filed: May 4, 2016

(65) Prior Publication Data

US 2016/0249130 A1 Aug. 25, 2016

Related U.S. Application Data

(63) Continuation of application No. PCT/CA2014/000796, filed on Nov. 7, 2014.

(60) Provisional application No. 61/904,955, filed on Nov. 15, 2013.

(51) Int. Cl.

| | |
|---|---|
| ***H04R 1/28*** | (2006.01) |
| ***H04R 1/02*** | (2006.01) |
| ***H04R 1/26*** | (2006.01) |

(52) U.S. Cl.

CPC ..... *H04R 1/2803* (2013.01); *H04R 1/02* (2013.01); *H04R 1/26* (2013.01); *H04R 2201/021* (2013.01)

(58) Field of Classification Search

CPC .. H04R 1/2888; H04R 1/2803; H04R 1/2869; H04R 1/30; H04R 1/34; H04R 1/345; H04R 1/28; H04R 2201/02; H04R 1/02; H04R 1/26

USPC ..... 381/391, 392, 340, 345, 337, 338, 386; 181/155, 199, 198

See application file for complete search history.

(56) References Cited

U.S. PATENT DOCUMENTS

| | | | | |
|---|---|---|---|---|
| 2,005,300 | A * | 6/1935 | Pfalzer | H04R 1/026 181/148 |
| 5,266,752 | A | 11/1993 | Cussans | |
| 6,625,292 | B2 | 9/2003 | Proni | |
| 2004/0003962 | A1 | 1/2004 | Gardner et al. | |
| 2007/0272476 | A1 | 11/2007 | Huang | |
| 2010/0032233 | A1 | 2/2010 | Moore | |

OTHER PUBLICATIONS

Wurlitzer Model 4000 Wall Speaker (1950s speaker, printed from icollector.com Jun. 12, 2017, last updated when sold Sep. 21, 2013).*

Nat P-Wave (from hometheatershack.com, printed Jun. 12, 2017, dated Jan. 1, 2008).*

(Continued)

*Primary Examiner* — Vivian C Chin
*Assistant Examiner* — Douglas J Suthers
(74) *Attorney, Agent, or Firm* — Bereskin & Parr LLP/S.E.N.C.R.L., s.r.l.

(57) ABSTRACT

A loudspeaker cabinet having at least one side wall defining a side wall perimeter; a front wall mounted to the at least one side wall along the side wall perimeter, the front wall having a front surface; wherein a central area of the front surface is positioned within the side wall perimeter, an extended area of the front surface extends beyond the side wall perimeter, and a portion of the extended area is configured to provide a gradual transition to open free space.

21 Claims, 5 Drawing Sheets

(56) References Cited

OTHER PUBLICATIONS

Wurlitzer Model 4000 Wall Speaker (1950s speaker, printed from icollector.com Jun. 12, 2017, last updated when sold Sep. 21, 2013) (Year: 2013).*
Nat P-Wave (from hometheatershack.com, printed Jun. 12, 2017, dated Jan. 1, 2008) (Year: 2008).*
"Speakal introduces the iPom apple/flower speaker thingy" (from slashgear.com, printed Mar. 22, 2018, dated Nov. 19, 2009) (Year: 2009).*
Documents relating to International Application No. PCT/CA2014/000796, dated Jan. 2015 (International Search Report and Written Opinion).
Document relating to European Application No. 14862666.6, dated May 31, 2017 (Extended European Search Report).

* cited by examiner

SPEAKER BAFFLE

This application is a continuation of International Application No. PCT/CA2014/000796 filed Nov. 7, 2014, which claims the benefit of U.S. Provisional Application No. 61/904,955 filed Nov. 15, 2013.

FIELD

Embodiments disclosed herein relate generally to loudspeaker cabinets, and more particularly to a front surface for a loudspeaker cabinet.

BACKGROUND

Sound system in auditoriums, theatres and private entertainment venues purposed for presenting an immersive visual and audio experience typically comprise several loudspeakers strategically positioned around an audience. In some of these sound systems (e.g. in cinema-type setups), one or more loudspeakers are positioned behind (or adjacent) the screen and directed towards the audience. Other loudspeakers may be positioned behind the audience, typically just below ceiling level. There may also be loudspeakers positioned beside the audience below the ceiling on the presentation auditorium side wall.

SUMMARY

In a first aspect, there is provided a loudspeaker cabinet comprising: at least one side wall defining a side wall perimeter; a front wall mounted to the at least one side wall along the side wall perimeter, the front wall having a front surface; wherein a central area of the front surface is positioned within the side wall perimeter, an extended area of the front surface extends beyond the side wall perimeter, and a portion of the extended area is configured to provide a gradual transition to open free space.

In some embodiments, the entire extended area is configured to provide the gradual transition to open free space.

In some embodiments, the portion of the extended area comprises a front surface edge, with at least one profile feature extending from the front surface edge.

In some embodiments, the front surface edge is positioned outside the side wall perimeter.

In some embodiments, the at least one profile feature comprises a tooth.

In some embodiments, the at least one profile feature comprises a sinusoidal wave.

In some embodiments, a length of the at least one profile feature is based on a distance from a centre of a speaker mounted to the central area to the front surface edge.

In some embodiments, the length of the at least one profile feature is between 10% and 40% of the distance from the centre of the speaker to the front surface edge.

In some embodiments, the length of the at least one profile feature is between 20% and 30% of the distance from the centre of the speaker to the front surface edge.

In some embodiments, the length of the at least one profile feature is about 25% of the distance from the centre of the speaker to the front surface edge.

In some embodiments: the at least one side wall comprises first and second side walls; the portion of the extended area comprises: a first front surface edge associated with the first side wall, with at least one first profile feature projecting from the first front surface edge, and a second front surface edge associated with the second side wall, with at least one second profile feature projecting from the second front surface edge; and the at least one first profile feature and the at least one second profile feature have different lengths.

In some embodiments, the length of the at least one first profile feature is based on a first distance from a centre of a first speaker mounted to the central area to the first front surface edge, and wherein the length of the at least one second profile feature is based on a second distance from a centre of a second speaker mounted to the central area to the second front surface edge.

In some embodiments, the length of the at least one first profile feature is between 10% and 40% of the first distance.

In some embodiments, the length of the at least one first profile feature is between 20% and 30% of the first distance.

In some embodiments, the length of the at least one first profile feature is about 25% of the first distance.

These and other aspects and features of various embodiments will be described in greater detail below.

BRIEF DESCRIPTION OF THE DRAWINGS

For a better understanding of embodiments of the apparatus and systems described herein, and to show more clearly how they may be carried into effect, reference will be made, by way of example, to the accompanying drawings in which.

DESCRIPTION OF EXEMPLARY EMBODIMENTS

Figure 1:
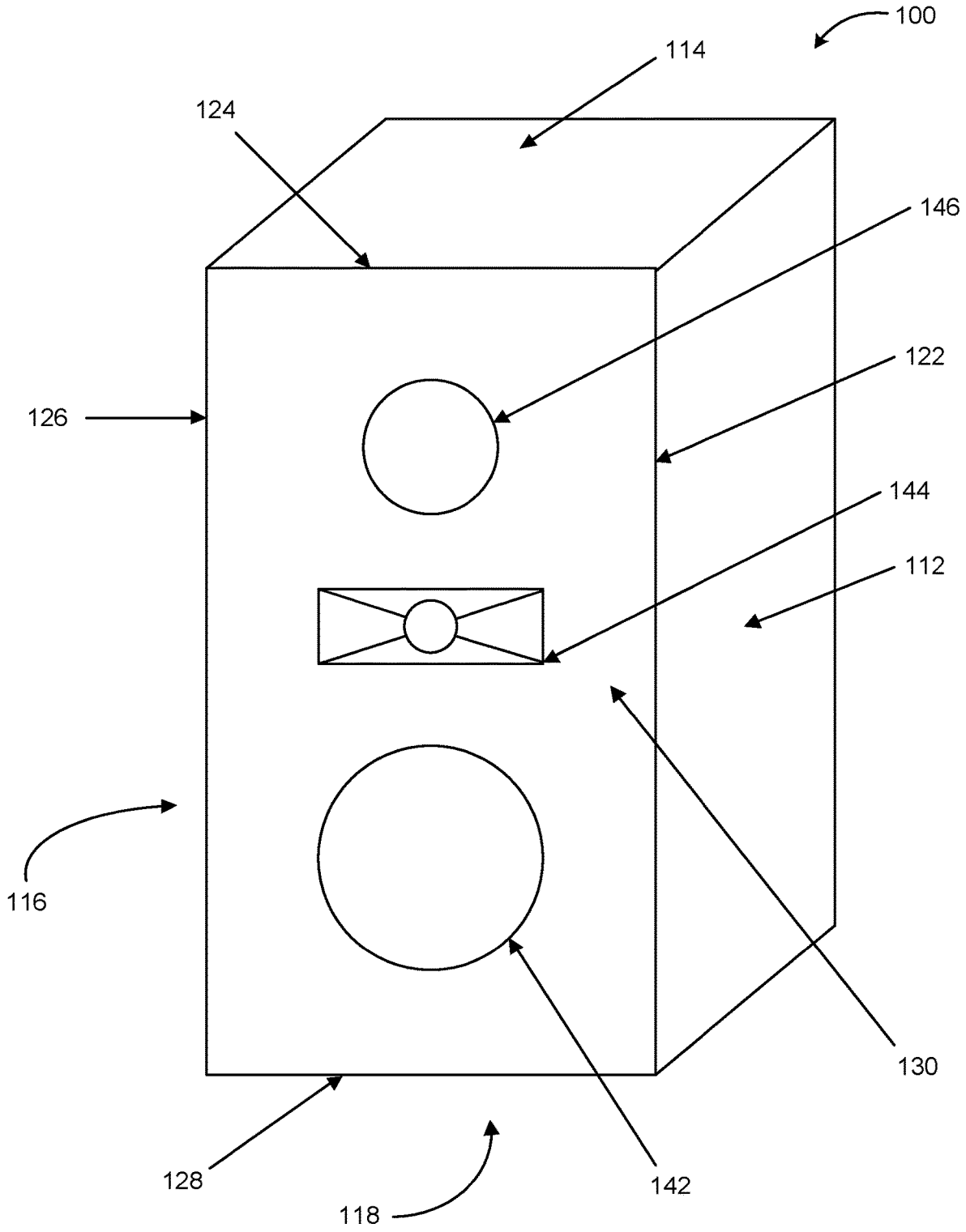
FIGURE 1 PRIOR ART
FIG. 1 is a front perspective view of a loudspeaker with a typical front surface.

Various embodiments will be described below to provide an example of each claimed invention. No example described below limits any claimed invention and any claimed invention may cover apparatuses or systems that are not described below. The claimed inventions are not limited to apparatuses or systems having all of the features of any one apparatus or system described below or to features common to multiple or all of the apparatuses described below. It is possible that an apparatus or system described below is not an embodiment of any claimed invention.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

Sound system in auditoriums, theatres and private entertainment venues purposed for presenting an immersive visual and audio experience typically comprise several loudspeakers strategically positioned around an audience. In some of these sound systems, one or more loudspeakers are positioned behind the screen and directed towards the audience. These loudspeakers may include a loudspeaker cabinet, and one or more speakers mounted to the front surface of the loudspeaker cabinet.

An example of such a loudspeaker is shown in FIG. 1. Loudspeaker 100 has four side walls 112, 114, 116, and 118 that define a perimeter of the cabinet enclosure. The front surface 130 and the side surfaces meet to form four edges 122, 124, 126, and 128. A rear surface (not shown) may be provided. Speakers 142, 144, and 146 are installed on the front surface 130 of the loudspeaker cabinet.

While the example loudspeaker cabinet may be cost effective, further improvements to achieving a flatter spectral response from the loudspeakers may be made.

Known problems associated with a loudspeaker in a cabinet (e.g. the example shown in FIG. 1) include audio reflections that can occur as a result of sudden surface transitions. One area of particular concern is the front surface of the cabinet in which the speaker is mounted on and the transition this surface makes with the side wall of the loudspeaker cabinet. In other words, the transitions at the edges 122, 124, 126, and 128.

It is these edges that can contribute audio reflection type artifacts causing amplitude deviations in the spectral response. The edge transition is seen as a change in impedance by the audio wave produced by the speaker. The edge causes the audio wave to disperse differently than had the wave continued to pass along a continuous surface. Sound waves produced by the speaker that have a ¼ wavelength, or an integer multiple of the ¼ wavelength, equal to the distance from the speaker to the edge of the loudspeaker cabinet will experience the most influence of the edge transition.

Audio waves that disperse differently can lead to audible spectral deviations in positions in front of the loudspeaker cabinet. Spectrally flat response is one desirable metric to have over an area where an audience is positioned, however, front surface transitions of a loudspeaker cause deviations from achieving the desired spectrally flat response.

One approach to dealing with this edge transition includes extending the front surface of the loudspeaker cabinet with added baffle segments (e.g. providing a larger front surface). Another approach includes providing a curved transition from the front surface to the side surface so the transition is more gradual. However, loudspeaker cabinets with extended baffles or baffles that transition smoothly from a front surface to a side surface tend to take up a relatively large volume. This may be particularly problematic where the loudspeaker cabinets are to be positioned behind (or adjacent) a screen in a cinema-type setup. For example, it may become cumbersome to mount such a loudspeaker cabinet within a screen support structure.

Yet another approach to dealing with edge transitions would be to make the front surface of the loudspeaker be a part of the wall, so that the wall becomes an extended baffle. But constructing a wall embedded with loudspeakers to extend the loudspeaker baffle becomes a more challenging solution, for example, where the loudspeakers are to be positioned behind a screen supported by a screen structure, or in a room corner behind the audience, and tends to drive up setup costs considerably.

Alternate configurations of loudspeaker cabinet design to address sudden surface transitions are disclosed below.

Figure 2A:
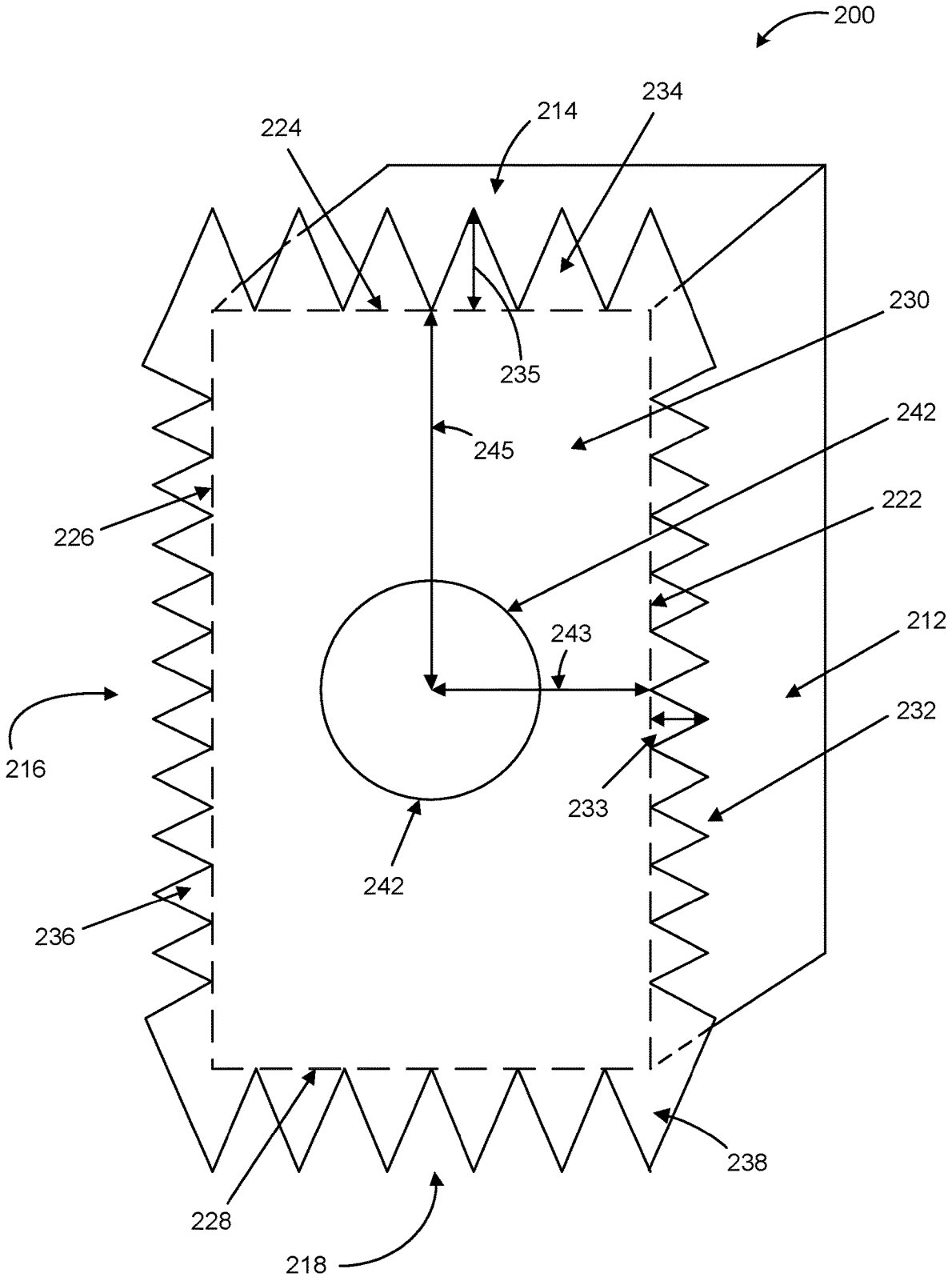
FIG. 2A is a front perspective view of a loudspeaker where a front surface has serrated edges.

An inventive solution to the problem of sudden surface transition in a loudspeaker cabinet is to create a tapered impedance change by creating a tapered loading effect with serrated edges. For example, FIG. 2A shows a loudspeaker 200 with a speaker 242 installed on a front surface 230 having serrated edges 232, 234, 236, and 238.

If the distance 243 from the centre of the speaker 242 to the edge 222 of the front surface is 30 cm, the ¼ wavelength frequency would be just under 300 Hz (i.e. ~286 Hz, assuming a speed of sound of 343 m/s). In this case, it is this frequency of sound in which the spectral response dispersion pattern is most influenced by the impedance transition at the cabinet edges causing reflections. The sound waves where the ¼ wavelength are integer multiples of the ~286 Hz ¼ wavelength (e.g. ~572 Hz, ~850 Hz, ~1,143 Hz, etc.) will also experience some influence of the surface transition.

It will be appreciated that the frequency of sound most influenced by the impedance transition at the cabinet edges is based on the relative dimensions of the loudspeaker cabinet. For example, assuming a distance 243 of 20 cm, sound with this ¼ wavelength frequency (i.e. sound with a frequency of just under 430 Hz) would be most influenced by the impedance transition at the cabinet edges, and if the distance 243 were 40 cm, sound with a frequency of just under 215 Hz would be most influenced.

The serrated edges 232, 234, 236, and 238 create a gradual air load transition on the sound wave between the front cabinet surface 230 and the portion of air beyond the edge of the front surface. The serrated edge essentially dampens the transition and also dampens sound reflections. The length of the teeth (232, 234, 236, and 238) forming the serration can vary. For example, the length of a tooth may be between 10% and 40%, between 20% and 30%, or about 25% of the distance from the centre of the speaker to the edge of the front cabinet surface. For example, the if distance 243 from the centre of the speaker 242 to the edge 222 of the front surface is 30 cm, the side teeth 232 may extend about 7.5 cm from the edge 222. Dampening the reflections with a transition that is in the order of 25% of the distance from the loudspeaker edge to the speaker may provide a reasonable amount of reflection dampening.

It will be appreciated that while the length of the teeth may be about 25% of the distance between the edge of the loudspeaker cabinet and the centre of the speaker, longer or shorter teeth may achieve a similar result. Longer tooth lengths generally provide a more gradual transition, but as the tooth length is increased there may be diminishing returns as far as the benefit to be had in reducing reflections. On the other hand, too short a length of the tooth may result in an insufficient gradient of impedance change for the sound and may result in a greater amount of sound reflections.

The serrated edges may be constructed in a way that flexure is controlled when sound emits from the speaker. In some embodiments, the front surface of the cabinet may be a continuous single sheet of material, so that the teeth are an integral part of the front cabinet surface. Alternatively, or additionally, one or more teeth may be fabricated separately and joined (e.g. glued) to the edges of the front surface of the cabinet.

While the thickness (depth) of the teeth may be the same as the thickness (depth) of the front surface of the loudspeaker cabinet, in some embodiments the ends of the teeth may be thicker (or thinner) than the front surface of the loudspeaker cabinet.

Figure 2B:
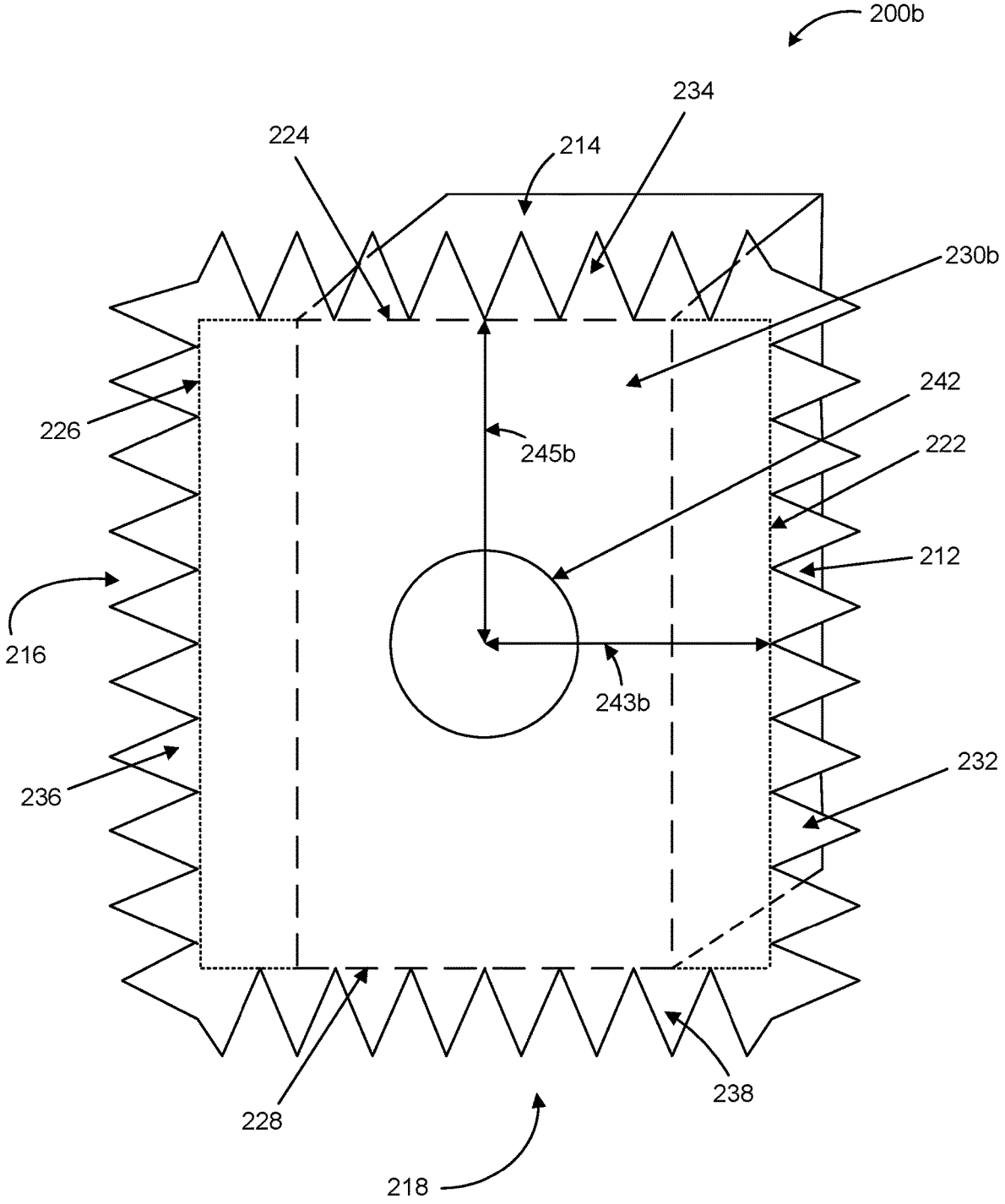
FIG. 2B is a front perspective view of another loudspeaker where a front surface has serrated edges.
Figure 3:
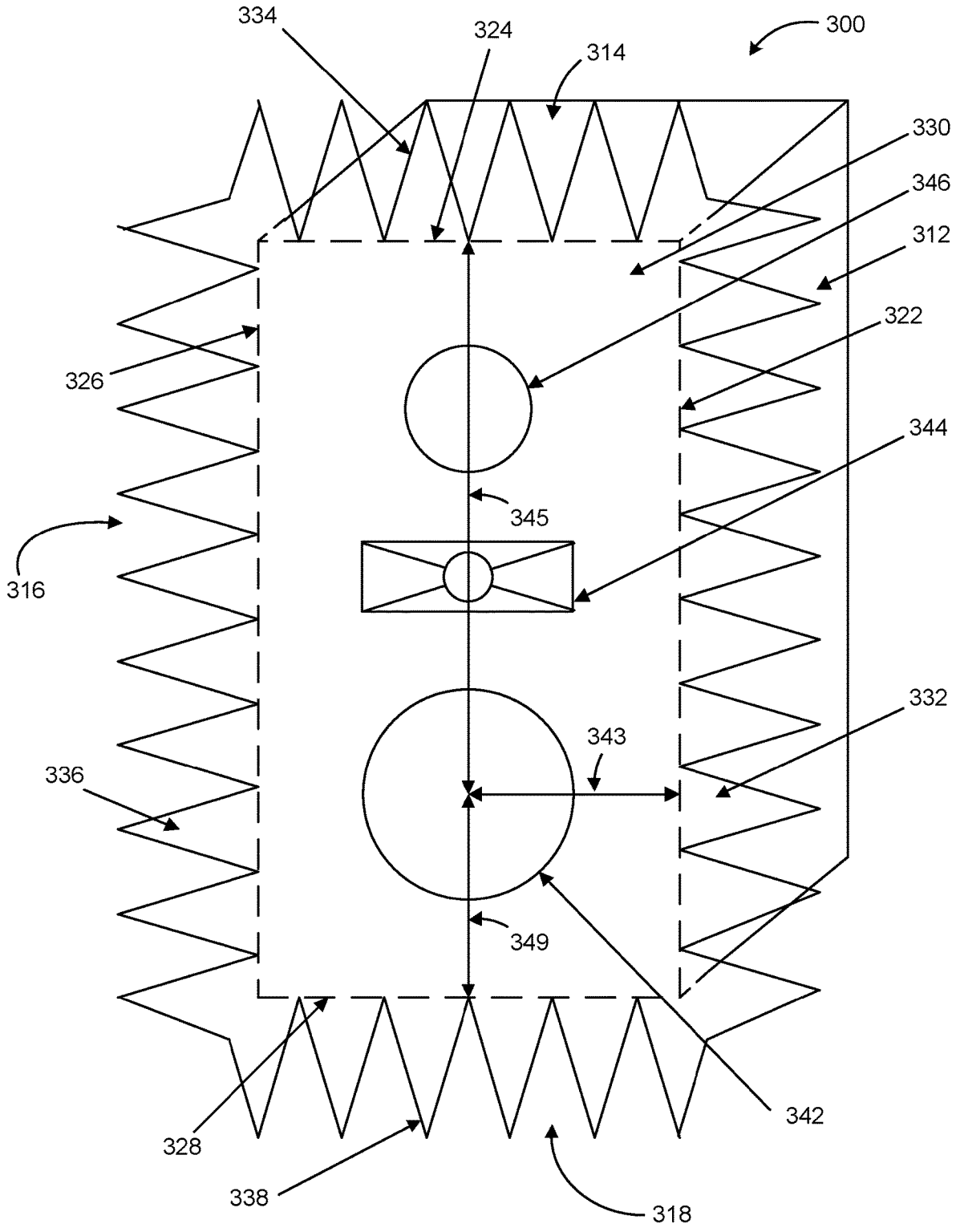
FIG. 3 is a front perspective view of yet another loudspeaker where a front surface has serrated edges.
Figure 4:
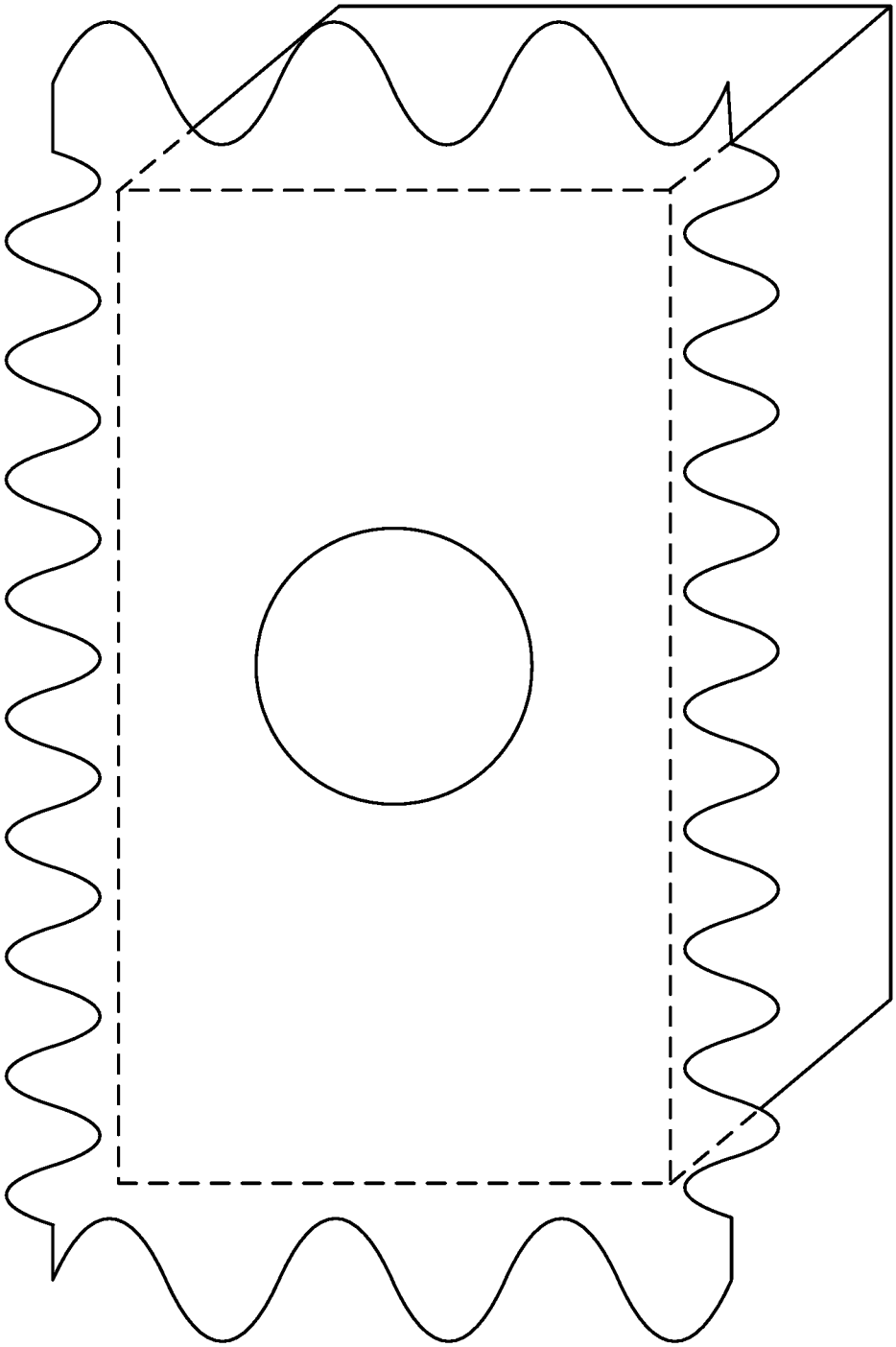
FIG. 4 is a front perspective view of another loudspeaker where a front surface has wavy edges.

The shape of the teeth may be any shape that leads to a gradual transition of the loudspeaker edge. For example, while triangular teeth are shown in FIGS. 2A-3, alternatively one or more of the teeth may have a wavy shape (e.g. a sinusoidal profile) as shown in FIG. 4, or an irregular contoured edge that provides some sort of gradual transition from a solid surface of the loudspeaker front surface to open space free of any surface area of the loudspeaker cabinet front surface.

In some loudspeaker configurations, the distance 245 from the centre of the speaker 242 to the upper and lower edges 224, 228 may be different than the distance 243 between the centre of the speaker 242 and the side edges 222, 226. In some embodiments, teeth of different lengths may be provided along the edges of the front surface, based on the distance from each particular edge to the centre of the speaker. For example, as shown in FIG. 2A the length 235 of tooth 234 for the top edge 224 may be longer than the length 233 of tooth 232 for the side edges 222 to compensate for the different distances between the speaker and the edges.

Alternatively, instead of providing teeth of different lengths, in some embodiments the teeth for each edge of the front surface may be the same length. For example, this length may be about 25% of the largest distance from the centre of the speaker to an edge of the front cabinet surface. For example, if the distance from the centre of the speaker to the side edges of the front surface is 30 cm (i.e. a 25% tooth length of about 7.5 cm), and the distance from the centre of the speaker to the top and bottom edges is 40 cm (i.e. a 25% tooth length of about 10 cm), each edge may be provided with teeth that extend outward about 10 cm. Such an arrangement may produce a better result than providing 7.5 cm teeth on each edge.

Alternatively, the front cabinet surface can be extended outwards so that the distance from the centre of the speaker to the side edges of the front surface is substantially the same as the distance from the centre of the speaker to the top and bottom edges of the front surface. For example, FIG. 2B shows a loudspeaker 200*b* with a front cabinet surface 230*b*, where the distance 243*b* from the centre of the speaker 242 to the side edges 222, 226 of the front surface is substantially equal to the distance 245*b* from the centre of the speaker 242 to the upper and lower edges 224, 228. Note that in this example configuration, the upper and lower edges 224, 228 of the front cabinet surface are generally aligned with the upper and lower side walls 214, 218 of the loudspeaker cabinet, while the side edges 222, 226 of the front surface are located beyond the side walls 212, 216.

FIG. 3 illustrates a loudspeaker 300 with three speakers 342, 344, and 346 installed on a front surface 330 having serrated edges 332, 334, 336, and 338 to create the tapered load transition from a solid front surface to open air or free space beyond the sides 312, 314, 316, 318 of the enclosure.

In the example shown in FIG. 3, speaker 342 may be a bass speaker that can create audio sound with a frequency from 80 to 300 Hz. At the lower frequencies the wavelength of sound is longer than several meters. Low frequency sound is omni-directional and typically has a wavelength much longer than any front surface dimension of the cabinet. Reflections from surface transitions at the low frequencies generally have little influence on the nature of the sound. Sound produced by the bass speaker in the 300 Hz region may have a ¼ wavelength that can be close to the dimension from the centre of the bass speaker to the cabinet edge (e.g. assuming that at least one of the distance 343, 345, and 349 from the centre of the speaker 342 to the edge 322, 342, and 328, respectively, of the front surface is ~30 cm).

Speaker 344 may be a high frequency speaker that can produce sound in the 3 kHz to 18 kHz range. The high frequency speaker 344 already has a horn that creates a high frequency sound dispersion pattern. Since the high frequency dispersion pattern is largely determined by the geometry of the horn, the front surface 330 of the cabinet generally has a negligible influence on the dispersion of sound waves generated by speaker 344. Therefore, where the front surface 330 meets up with the sides has little influence on the higher frequencies of sound, however as the loudspeaker enclosure is reduced in size the influence of front to side edge transition of the loudspeaker can become more significant. For example, if a first loud speaker cabinet has a distance from the centre of the high frequency speaker 344 to edge 322 on the front surface of 0.3 m this dimension is relatively large with respect to the ¼ wavelength (i.e. 0.028 m) of the lower frequency of the 3 KHz to 18 kHz high frequency speaker. If the size of a second loud speaker cabinet (e.g. a compact loud speaker cabinet) is a quarter of the size in height, width and depth of the first loudspeaker cabinet, the distance from the centre of the high frequency speaker to the edge of the cabinet is 0.075 meters. The 0.075 meter dimension is much closer to the ¼ wavelength (i.e. 0.028 m) of the lower frequency (3 kHz) of the high frequency (3 kHz to 18 kHz) speaker and therefore the influence of front to side edge transition of the loudspeaker can be greater.

Speaker 346 may be a mid-range speaker that can produce sound in the 300 to 3 kHz range. The wavelength of sound for such a mid-range frequency is from about 1 m to 10 cm, and thus the ¼ wavelength of sound generated by the mid-range speaker may be close to the dimension from the centre of speaker 346 to the edges 322, 342, and 328 of the loudspeaker cabinet. Assuming that the centre of speaker 346 is ~30 cm from at least one of the edges 322, 342, and 328, it may be the crossover frequency (e.g. 300 Hz) of sound for which the spectral response dispersion pattern may be most influenced by the impedance transition at the cabinet edges causing reflections.

In some embodiments, the serrated edges may be configured for two sources such that the length of the teeth is in the order of 25% of the length of the longer speaker source distance to the cabinet edge for the bass speaker. For example, as shown in FIG. 3 the distance 345 from the centre of speaker 342 to edge 324 is greater than the distance 349 from the centre of speaker 342 to edge 328. The serrated edges may be configured such that the length of the teeth 334 and 338 extending from edges 324 and 328, respectively, is about 25% of the distance 345. Alternatively, the serrated edges may be configured such that the length of the teeth 338 extending from edge 328 is about 25% of the distance 349.

In embodiments where a loudspeaker cabinet contains multiple mid-range and/or bass speakers, other configurations of serrated edges may be provided. In some embodiments, the length of the teeth may be based on a ratio of the longest distance between the edge of the cabinet and to the centre of a bass or midrange speaker.

Another approach is to extend the solid surface of the shorter dimension to be similar as one of the longer dimensions from the cabinet edge to a speaker centre.

As used herein, the wording "and/or" is intended to represent an inclusive—or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

We claim:

1. A loudspeaker cabinet comprising:

a plurality of side walls defining a side wall perimeter, the plurality of side walls comprising a first side wall and a second side wall;

a front wall mounted to the first side wall along a first side wall edge and the second side wall along a second side wall edge, the first side wall edge being a vertical edge, and the second side wall edge being a horizontal edge, the front wall having a front surface; and an extended area extending outwardly with respect to the first side wall edge and the second side wall edge, the extended area being substantially coplanar with the front surface;

wherein the front surface with comprises at least two speakers mounted along a vertical center axis of the cabinet such that each speaker is positioned within the side wall perimeter with a first distance in a first direction between a center of the corresponding speaker and the first side wall edge, wherein a portion of the extended area comprises at least one profile feature in the first direction, the front surface and the at least one profile feature forming a continuous surface, the at least one profile feature having a length based on the first distance enabling the portion of the extended area to provide a gradual transition to open free space to create a gradual air load transition on sound waves produced by the at least two speakers.

2. The loudspeaker cabinet of claim 1, wherein the entire extended area is configured to provide the gradual transition to open free space.

3. The loudspeaker cabinet of claim 1, wherein the portion of the extended area comprises a linear extension of the front surface in the first direction terminating in a first front surface edge, with at least one first profile feature extending from the first front surface edge.

4. The loudspeaker cabinet of claim 3, wherein the length of the at least one first profile feature is based on a distance from the center of one of the at least two speakers to the first front surface edge.

5. The loudspeaker cabinet of claim 4, wherein the length of the at least one first profile feature is between 10% and 40% of the distance from the center of one of the at least two speakers to the first front surface edge.

6. The loudspeaker cabinet of claim 3, wherein:

the portion of the extended area further comprises:

a second front surface edge associated with the second side wall, with at least one second profile feature projecting from the second front surface edge in the second direction.

7. The loudspeaker cabinet of claim 6, wherein the length of the at least one second profile feature is based on a second distance from the center of a speaker of at least two speakers with the lowest frequency range to the second front surface edge in the second direction.

8. The loudspeaker cabinet of claim 7, wherein the length of the at least one second profile feature is between 10% and 40% of the second distance.

9. The loudspeaker cabinet of claim 1, wherein the at least one profile feature comprises a tooth.

10. The loudspeaker cabinet of claim 1, wherein the at least one profile feature comprises a sinusoidal wave.

11. The loudspeaker cabinet of claim 1, wherein the portion of the extended area comprises a plurality of adjacent profile features configured to provide a gradual transition to open free space to create a gradual air load transition on sound waves produced by the at least one speaker.

12. The loudspeaker cabinet of claim 1, wherein the at least one profile feature is integral with the front surface.

13. The loudspeaker cabinet of claim 1, wherein the extended area further comprises at least one profile feature extending from the second side wall edge in a second direction, the at least one profile feature in the second direction profile feature having a length based on a second distance in the second direction between a center of one of the at least two speakers with the lowest frequency range to the second side wall edge.

14. A loudspeaker cabinet comprising:

a plurality of side walls defining a side wall perimeter, the plurality of side walls comprising a first side wall and a second side wall;

a front wall mounted to the first side wall along a first side wall edge and the second side wall along a second side wall edge, the first side wall edge being a vertical edge, and the second side wall edge being a horizontal edge, the front wall having a front surface; and an extended area extending outwardly with respect to the first side wall edge and the second side wall edge, the extended area being substantially coplanar with the front surface;

wherein the front surface comprises at least two speakers mounted along a vertical axis of the cabinet such that each speaker is positioned within the side wall perimeter with a first side wall distance in a first direction between a center of the corresponding speaker and the first side wall edge, and wherein a portion of the extended area comprises a first linear extension of the front surface in the first direction terminating in a first front surface edge, with at least one first profile feature extending from and forming a continuous surface with the first front surface edge, the at least one first profile feature having a length based on a first surface edge distance between the center of one of the at least two speakers and the first front surface edge enabling the at least one first profile feature to provide a gradual transition to open free space to create a gradual air load transition on sound waves produced by the at least two speakers.

15. The loudspeaker cabinet of claim 14, wherein the at least one first profile feature comprises a triangular tooth.

16. The loudspeaker cabinet of claim 14, wherein the at least one first profile feature comprises a wavy tooth.

17. The loudspeaker cabinet of claim 14, wherein the at least one first profile feature is integral with the front surface.

18. The loudspeaker cabinet of claim 14, wherein the portion of the extended area further comprises a second linear extension of the front surface in the second direction terminating in a second front surface edge, with at least one second profile feature extending from and forming a continuous surface with the second front surface edge, the at least one second profile feature having a length based on a second surface edge distance between a center of one of the at least two speakers with the lowest frequency range and the second front surface edge.

19. A loudspeaker cabinet comprising:

a plurality of side walls defining a side wall perimeter, the plurality of side walls comprising a first side wall and a second side wall;

a front wall mounted to the first side wall along a first side wall edge and the second side wall along a second side wall edge, the first side wall edge being a vertical edge, and the second side wall edge being a horizontal edge, the front wall having a front surface; and an extended area extending outwardly with respect to the first side wall edge and the second side wall edge, the extended area being substantially coplanar with the front surface;

wherein the front surface comprises at least two speakers mounted along a vertical axis of the cabinet such that each speaker is positioned within the side wall perimeter with a first distance in a first direction between a center of the corresponding speaker and the first side wall edge, and wherein a portion of the extended area comprises a first plurality of profile features in the first direction, each of the first plurality of profile features having a length based on the first distance enabling a first plurality of adjacent profile features to provide a gradual transition to open free space to create a gradual air load transition on sound waves produced by the at least two speakers, and wherein the front surface and the first plurality of profile features form a continuous surface.

20. The loudspeaker cabinet of claim 19, wherein the first plurality of profile features are integral with the front surface.

21. The loudspeaker cabinet of claim 19, wherein the portion of the extended area further comprises a second plurality of profile features extending from the second side wall edge in the second direction, each of the second plurality of profile features having a length based on a second distance in the second direction between a center of one of the at least two speakers with the lowest frequency range to the second side wall edge.

* * * * *